United States Patent [19]

Rose

[11] Patent Number: 4,973,177

[45] Date of Patent: Nov. 27, 1990

[54] WRITING INSTRUMENT KIT

[76] Inventor: Bruce N. Rose, 134 Hermes St., Simi, Calif. 93065

[21] Appl. No.: 432,369

[22] Filed: Nov. 6, 1989

[51] Int. Cl.[5] ..... A44B 21/00; B65D 85/20

[52] U.S. Cl. ..... 401/52; 206/371; 206/224; 206/460; 24/10 R

[58] Field of Search ..... 401/52; 206/224, 214, 206/575, 233, 371, 460, 131; 24/10 R; 40/594, 595

[56] References Cited

U.S. PATENT DOCUMENTS

| | | | |
|---|---|---|---|
| D. 149,897 | 6/1948 | McFadyen . | |
| D. 185,331 | 5/1959 | Tannenbaum . | |
| D. 202,674 | 10/1965 | Dales . | |
| D. 276,479 | 11/1984 | Mori . | |
| D. 281,174 | 10/1985 | Mahoney et al. . | |
| 3,128,514 | 4/1964 | Parker | 401/52 |
| 3,370,818 | 2/1968 | Perr | 24/10 R |
| 3,387,341 | 6/1968 | Mates | 24/10 R |
| 3,466,774 | 9/1969 | Sorrenson | 401/52 |
| 4,682,691 | 7/1987 | Spiering | 206/460 |
| 4,852,221 | 8/1989 | Antonucci | 24/10 R |

*Primary Examiner*—Richard J. Johnson
*Attorney, Agent, or Firm*—Leon Gilden

[57] ABSTRACT

A writing instrument kit is set forth wherein a writing instrument is provided with a cap and body portion, each of a generally cylindrical configuration defined about a single axis, wherein the cap or body portion is each provided with a hook and loop fastener surface. The hook and loop fastener surface of the body portion is in surrounding relationship to the body and is optionally provided with slots for reception of a flexible sleeve formed with complementary projections receivable within the slots for use of the instrument without abrasion to an individual's hand. The kit includes a cleaning member and a securement pad formed with a hook and loop fastener surface for adhesive securement to a support surface as desired by an individual.

4 Claims, 4 Drawing Sheets

PRIOR ART

FIG 5
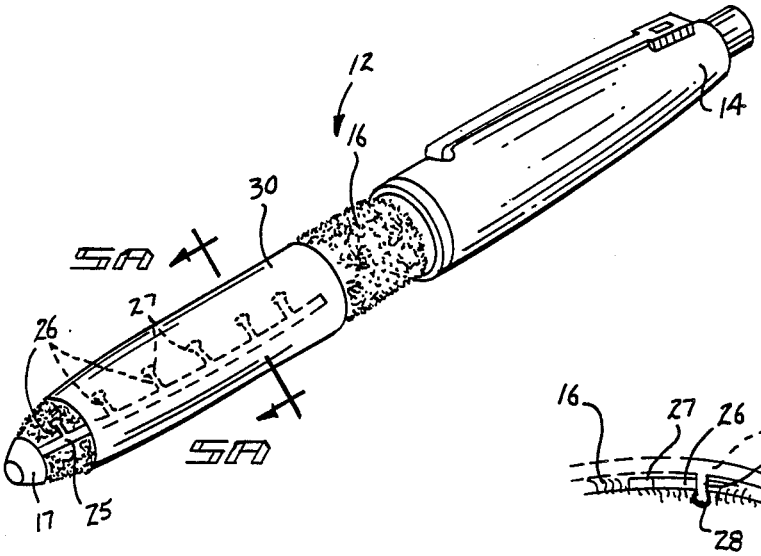
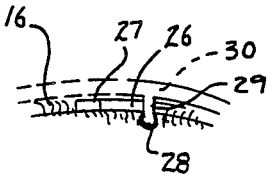
FIG 5A
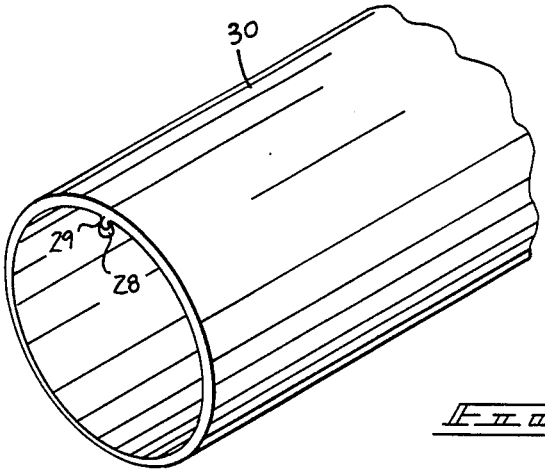
FIG 6

FIG 7
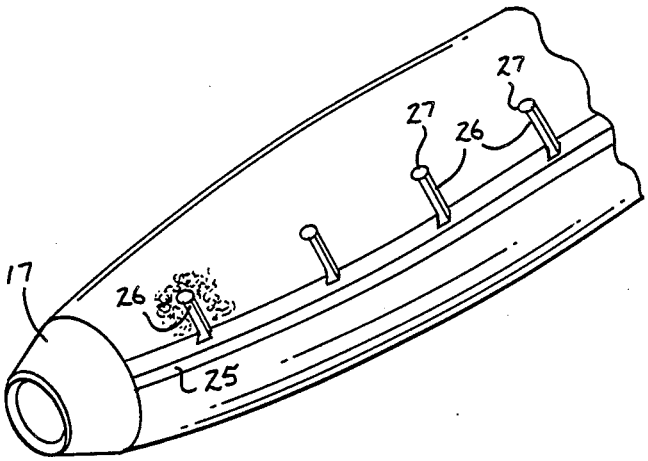
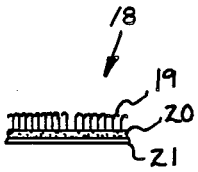
FIG 8

WRITING INSTRUMENT KIT

BACKGROUND OF THE INVENTION

1. Field of the Invention

The field of invention relates to writing instruments, and more particularly pertains to a new and improved writing instrument kit wherein the same is provided with hook and loop fastener surfaces for selective securement of a writing instrument to a desired surface.

2. Description of the Prior Art

The prior art has provided instruments of a variety of configurations for securement to various surfaces as desired. The instruments of the prior art, however, have heretofore utilized permanent anchoring members for a permanent securement of a receptacle that receives a pen slidably therewithin. Inasmuch as it is desirable to quickly and selectively position a writing instrument about various surfaces in various orientations, the instant invention has set forth a kit assembly for enabling selective securement of a strip to a desired surface for temporary securement of a writing instrument thereto. Examples of the prior art include U.S. Design patent 149,897 to McFadyen; U.S. Design patent 185,331 to Tannenbaum; U.S. Design patent 281,174 to Mahoney, et al.; and U.S. Design patent 276,479 to Mori. The design patents are illustrative of writing instruments with various securement tabs of mechanical characteristic to secure a writing instrument by use of a tether and the like to a support surface.

As such, it may be appreciated that the writing instrument kit of the instant invention attempts to overcome the problems associated with the prior art by providing an organization with the characteristics of ease of use and effectiveness in construction and in this respect, the present invention substantially fulfills this need.

SUMMARY OF THE INVENTION

In view of the foregoing disadvantages inherent in the known types of writing instruments now present in the prior art, the present invention provides a writing instrument kit wherein the same enables selective and temporary securement of a writing instrument to an associated anchoring strip. As such, the general purpose of the present invention, which will be described subsequently in greater detail, is to provide a new and improved writing instrument kit which has all the advantages of the prior art writing instruments and none of the disadvantages.

To attain this, the writing instrument kit of the instant invention includes an impermeable, flexible package containing an alcohol or solvent based saturated pad for initially cleansing a surface and further including an anchoring strip member formed with a hook and loop fastener surface on an exterior side of the strip with an adhesive pad on the reverse side of the strip for securement to the aforenoted prepared surface. The writing instrument includes a hook and loop fastener surface in surrounding relationship to the body of the writing instrument, or selectively to a single strip associated with the cap. Should the writing instrument include a surrounding hook and loop fastener body surface, a flexible securement sleeve is provided with interengaging projections for reception within slots provided within the hook and loop fastener surface of the writing instrument body to provide a grasping surface for an individual free of abrasion and contact with the hook and loop fastener surface on the body of the writing instrument.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved writing instrument kit which has all the advantages of the prior art writing instruments and none of the disadvantages.

It is another object of the present invention to provide a new and improved writing instrument kit which may be easily and efficiently manufactured and marketed.

It is a further object of the present invention to provide a new and improved writing instrument kit which is of a durable and reliable construction.

An even further object of the present invention is to provide a new and improved writing instrument kit which is susceptible of a low cost of manufacture with regard to both materials and labor, and which accordingly is then susceptible of low prices of sale to the consuming public, thereby making such writing instrument kits economically available to the buying public.

Still yet another object of the present invention is to provide a new and improved writing instrument kit which provides in the apparatuses and methods of the prior art some of the advantages thereof, while simultaneously overcoming some of the disadvantages normally associated therewith.

Still another object of the present invention is to provide a new and improved writing instrument kit wherein the same is provided with an anchoring strip to enable selective securement of a writing instrument to a preselected surface receiving the anchoring strip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of a further modified writing instrument of the instant invention.

FIG. 6 is an isometric illustration, partially in section and somewhat enlarged to illustrate detail of a sleeve utilized by the instrument of FIG. 5.

FIG. 7 is an isometric illustration, somewhat enlarged, of the writing instrument of FIG. 5.

FIG. 8 is an orthographic cross-sectional view taken along the lines 8—8 of FIG. 3 in the direction indicated by the arrows.

DESCRIPTION OF THE PREFERRED EMBODIMENT

Figure 1:
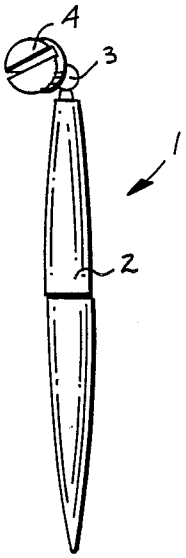
FIG. 1 is an isometric illustration of a prior art writing instrument assembly.

With reference now to the drawings, and in particular to FIGS. 1 to 8 thereof, a new and improved writing instrument kit embodying the principles and concepts of the present invention and generally designated by the reference numeral 10 will be described.

Figure 2:
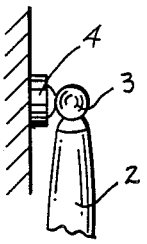
PRIOR ART Fig 2
FIG. 2 is a orthographic side view taken in elevation of a writing instrument assembly secured to an associated support surface.
Figure 3:
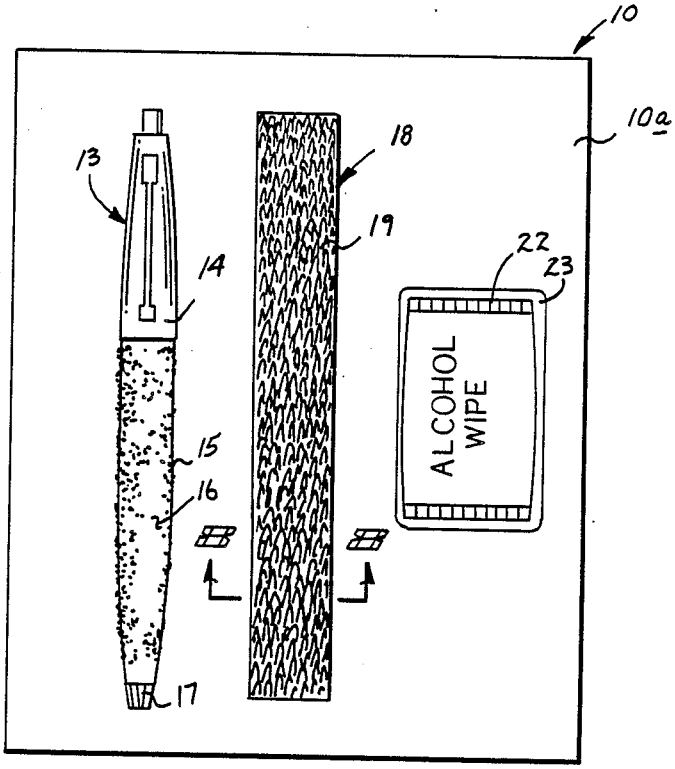
FIG. 3 is a top orthographic view of the writing instrument kit of the instant invention.

More specifically, &he writing instrument kit 10 of the instant invention essentially comprises an improvement of the prior art, as illustrated in FIGS. 1 and 2, wherein a writing instrument assembly 1 includes a support sleeve 2 for sliding reception of a writing instrument therewithin where a ball and socket arrangement 3 is secured to an anchor 4 that is permanently mounted to a support surface, as illustrated in FIG. 2.

The writing instrument kit 10 includes a pen assembly 13 formed with a generally tapered cylindrical cap 14 coaxially arranged with a cylindrical body 15 containing conventional writing instrument elements therewithin displaceable by a conventional push-button arrangement directed coaxially through the top of the cap 14. The cylindrical body is formed with a lowermost skirt 17 with a first hook and loop fastener surface 16 secured about the entire cylindrical body 15 between the skirt 17 and the cylindrical cap 14. The first hook and loop fastener surface 16 is selectively securable to a second hook and loop fastener surface 19 formed on an upper surface of a planar anchor strip 18. Reference to the illustration of FIG. 8 indicates an adhesive surface 20 formed on a reverse surface of the anchor strip 18 with a covering flexible peel-away strip 21 overlying the adhesive surface 20 to enable mounting of the anchor strip 18 to a desired surface. Preparation of the surface is effected by use of an enclosed alcohol soaked pad 22 contained within an impermeable envelope 23, wherein the writing instrument or pen assembly 13, the anchor strip 18, and the envelope 23 are all mounted upon a card member 10*a*. The alcohol soaked pad 22 is utilized to cleanse and remove undesirable dirt, grease, and the like from a surface prior to mounting of the anchor strip 18 thereon.

Figure 4:
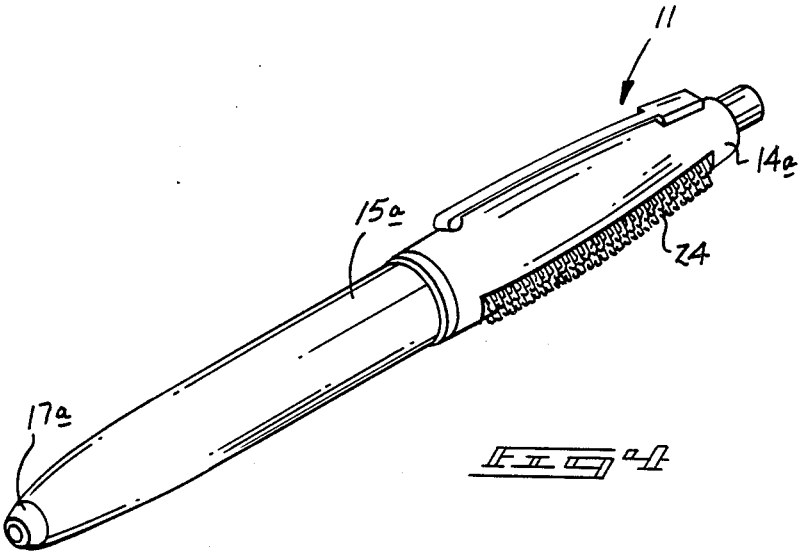
FIG. 4 is an isometric illustration of a modified writing instrument of the instant invention.

FIG. 4 is illustrative of a modified writing instrument 11 including a tapered cylindrical cap 14*a* coaxially mounted to an elongate cylindrical body 15*a* with a skirt 17*a* formed at a lowermost end of the body 15*a* remote from the cap 14*a*. A third elongate hook and loop fastener strip 24 is mounted longitudinally of the body cap 14*a* for selective securement to the anchor strip 18 to avoid abrasion of the first hook and loop fastener surface 16 to a hand of an individual when grasping the instrument.

Inasmuch as the completely enveloping first hook and loop fastener surface 16 is desirable to enable ease of securement of the writing instrument onto the second hook and loop fastener strip surface 19, a further modified writing instrument 12, is illustrated in FIG. 5. An axially parallel rib 25 is mounted overlying the first hook and loop fastener surface and is longitudinally mounted thereof formed with orthogonally positioned slots 26 positioned at predetermined intervals along the rib 25. The slot includes a bore 27 at the end of each slot for receiving cylindrical ends 28 of rigid registration bosses 29 formed coaxially and interiorly of an interior surface of a flexible sleeve 30. The flexible sleeve 30 is positionable overlying the first hook and loop fastener surface 16 with the registration bosses and cylindrical ends 28 positionable within each of the bores 17, whereupon the registration bosses 29 are then slid interiorly of the slots 26 to lock the sleeve 30 overlying a preselected portion of the first hook and loop fastener surface 16. The positionable sleeve 30 enables selective positioning of the sleeve to accommodate individual preferences of one utilizing the writing instrument 12.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A writing instrument kit comprising, a cleansing means for permitting cleansing and degreasing of a support surface, and an elongate writing instrument including a first fastening surface integrally mounted thereon, and an anchoring strip including a top surface, wherein the top surface includes a second fastening surface and a bottom surface of the anchoring strip including an adhesive surface coextensively formed thereon for securement to the support surface, and wherein the cleansing means, the writing instrument, and the anchoring strip are mounted upon a single card member for ease of transport and delivery of the kit to an individual, and wherein the first fastening surface and the second fastening surface comprise a first hook and loop fastener surface and a second hook and loop fastener surface respectively, and wherein the elongate writing instrument includes a tapered cylindrical cap coaxially aligned with a cylindrical body, the cylindrical body terminating in a skirt surrounding a lowermost opening of the writing instrument, and the first hook and loop fastener surface completely surrounding the body, and wherein an elongate rib is longitudinally aligned overlying the first hook and loop fastener surface, and wherein the rib includes a series of slots spaced at predetermined intervals and orthogonally arranged relative to the rib, wherein each of the slots terminate in a bore.

2. A writing instrument kit as set forth in claim 1 further including a flexible sleeve slidably receivable over the body, and the sleeve including a series of registration bosses orthogonally directed interiorly of an interior surface of the sleeve, wherein each of the bosses is spaced at the predetermined intervals and each boss terminates in a cylindrical end receivable within each of the bores to enable securement of the flexible sleeve to the body.

3. A writing instrument kit as set forth in claim 2 wherein the anchor strip includes a flexible peel-away strip overlying the adhesive surface to prevent contamination of the adhesive surface prior to securement of the anchor strip to the support surface.

4. A writing instrument kit as set forth in claim 3 wherein the cleansing means includes an impermeable envelope, the envelope including an alcohol soaked pad permitting degreasing and cleansing of the support surface.

* * * * *